United States Patent [19]

Greenberg

[11] Patent Number: 4,475,226

[45] Date of Patent: Oct. 2, 1984

[54] STEREO SOUND AND LIGHT TRACK SYSTEM

[75] Inventor: Arthur L. Greenberg, Boca Raton, Fla.

[73] Assignee: Donald Blechman, Miami Beach, Fla. ; a part interest

[21] Appl. No.: 544,078

[22] Filed: Oct. 21, 1983

[51] Int. Cl.[3] ..... F21S 1/02; H04R 1/02

[52] U.S. Cl. ..... 381/24; 179/146 L; 381/87; 362/370

[58] Field of Search ..... D26/61; 381/24, 77, 381/80–82, 87–91, 124; 179/146 R, 146 L, 146 H; 362/217–221, 150, 245, 250, 285, 368, 370, 372, 404, 418, 430

[56] References Cited

U.S. PATENT DOCUMENTS

| | | | |
|---|---|---|---|
| 2,924,661 | 2/1960 | Messeas, Jr. . | |
| 3,061,973 | 11/1962 | Oberdorf | 381/90 X |
| 3,082,839 | 3/1963 | Whitcas . | |
| 3,369,078 | 2/1968 | Stradley | 381/77 X |
| 3,385,929 | 5/1968 | Magyar et al. . | |
| 3,679,845 | 7/1972 | Geloso | 179/146 R |
| 4,052,564 | 10/1977 | Propst | 181/153 X |
| 4,057,689 | 11/1977 | Stallings, Jr. | 381/90 |
| 4,075,438 | 2/1978 | Kappel | 179/146 H |
| 4,194,086 | 3/1980 | Solla . | |
| 4,210,784 | 7/1980 | Phillips | 179/146 H |
| 4,334,211 | 6/1982 | McConnell et al. | 362/217 X |
| 4,420,798 | 12/1983 | Herst et al. | 362/370 X |

FOREIGN PATENT DOCUMENTS

| | | | |
|---|---|---|---|
| 0023666 | 2/1980 | Japan | 381/77 |

*Primary Examiner*—R. J. Hickey

*Attorney, Agent, or Firm*—Kirschstein, Kirschstein, Ottinger & Israel

[57] ABSTRACT

A stereo sound and light track system includes one or more sound fixtures and one or more light fixtures, each fixture being independently mounted for movement on a track to any mounted position thereon. A bus bar assembly including audio bus bar conductors and power bus bar conductors are mounted on the track which is grounded. Connectors are provided on the fixtures to make electromechanical contact with the appropriate bus bar conductors and ground. Stereo sound can be transmitted by the sound fixtures and light can be emitted from the light fixtures in any of their respective mounted positions.

21 Claims, 8 Drawing Figures

TO TRACK

STEREO SOUND AND LIGHT TRACK SYSTEM

BACKGROUND OF THE INVENTION

1. Field of the Invention

The present invention generally relates to a sound track system and, more particularly, to a sound and light track system on which both sound-transmitting fixtures and light-emitting fixtures are mounted at any desired location along the track and at any selected orientation relative thereto.

2. Description of the Prior Art

It is well-known in the prior art to mount loudspeakers in a wide variety of different locations. In home entertainment stereo systems, loudspeakers are generally mounted on a floor, or on a wall, or on a wall unit. In paging systems of the type found at airports, schools, hospitals, hotels, etc., loudspeakers are generally permanently installed in the walls. Loudspeakers can also be mounted on a chair behind a seated occupant, or on a movable floor stand, or on a countertop, or on a ceiling, or on a counter-top stand, or on a column attached to the ceiling, or on a low partition wall, etc. See, for example, U.S. Pat. Nos. 2,924,661; 3,082,839; 3,385,929; 3,679,845; 4,052,564; 4,194,086; and 4,210,784.

One of the drawbacks of the permanently mounted speaker installations is that the speakers cannot be conveniently moved. Even in installations where the speakers are not permanently installed in the walls or ceilings and are otherwise movable, any electrical wiring which interconnects the speakers to the sound system tends to limit the extent of any such movement. Thus, the length of the electrical wiring, unless the sound system is completely rewired, limits the maximum extent of any such speaker movement. Also, the very physical presence of the wiring itself, which is generally regarded as a safety hazard when left in pedestrian walkways and which is generally regarded as aesthetically unsightly when left in the open, tends to limit the extent to which the speakers can be moved due to such safety and aesthetic reasons. Audio systems with built-in speakers such as U.S. Pat. No. 4,052,564 are movable from place to place; however, only to places which can accommodate the entire audio system.

It is also known in the prior art to mount light fixtures on overhead light track systems. Such light track systems are solely used for illumination purposes, that is, to light selected areas of a room.

SUMMARY OF THE INVENTION

Objects of the Invention

Accordingly, it is the general object of the present invention to overcome the aforementioned drawbacks of the prior art.

Another object of this invention is to conveniently move one or more sound fixtures to any desired position along a track without restricting the movement by a fixed length of any wiring connected to speakers in the fixtures.

It is another object of this invention to conveniently move one or more sound fixtures to any desired position along the track without being restricted by safety and aesthetic considerations caused by exposed wiring left in pedestrian walkways.

It is still another object of this invention to move one or more sound fixtures from place to place without also moving the entire audio system.

It is yet another feature of this invention to conveniently move one or more light fixtures and sound fixtures on and along the same track.

Still another object of this invention is to provide a stereo sound and light track system which is inexpensive and simple in construction, versatile and durable in use, and easy to install, particularly in home environments.

FEATURES OF THE INVENTION

In keeping with these objects and others which will become apparent hereinafter, one feature of the invention resides, briefly stated, in a sound track system which comprises a support, particularly an overhead elongated support mounted on a ceiling, an elongated audio bus bar conductor, and means for mounting the audio conductor on the support. In addition, an electrical audio signal is connected to the audio conductor for electrical conduction therealong, and an electrical ground is provided on the support. Preferably, the support has an electrically conducting body portion which is grounded. The grounded body portion extends substantially parallel to the elongation of the audio conductor and is also electrically insulated from the same.

The system also includes sound fixture means for transmitting sound when operatively connected to the audio signal and to the ground. Means are provided for mounting the sound fixture means in electromechanical connection with the audio conductor and the ground. The sound fixture means is movable along the elongation of the audio conductor to any desired mounted position in each of which the sound fixture means is simultaneously electromechanically connected with the audio conductor and the ground.

In accordance with the invention, the sound fixture means is permitted to transmit sound in any desired mounted position along the support. The sound fixture means is conveniently movable in infinitely variable manner on and along the audio conductor and on and along the grounded body portion. The movement of the sound fixture means is not restricted by the length of any electrical wiring connected to a speaker mounted in the sound fixture means. There is no such electrical wiring which limits the maximum extent of the movement of the sound fixture means, nor are there any safety hazards as a result of leaving any such electrical wiring out in a pedestrian walkway, or any electrical wiring to be tangled to detract from aesthetic considerations.

In accordance with another feature of this invention, an elongated hot power conductor and an elongated neutral power conductor are mounted on the support in substantial parallelism with and electrically insulated from each other. A hot terminal and a neutral terminal of an electrical power source are respectively connected to the hot and the neutral power conductors. A light fixture means is mounted in electromechanical connection with the power conductors and the ground. The light fixture means is operative for emitting light when it is operatively connected to the hot and neutral terminals and to the ground. The light fixture means is movable along the elongation of the power conductors to any desired mounted position in each of which the light fixture means is simultaneously electromechanically connected with the power conductors and the ground. This feature permits the sound fixture means to transmit sound and also permits the light fixture means to emit light in any of their respective mounted positions.

The mounting of both a light fixture means and a sound fixture means on and along the same elongated support provides a novel combined sound and light track system. Each fixture means is preferably adjustably positionable to any desired orientation relative to the support. Thus, the light emitted from the light fixture means can be projected to any selected area of a room and, if desired, the sound transmitted by the sound fixture means can be broadcast to any selected area of the room. By orienting each fixture means in any desired orientation, it is possible to create a unique and changeable sound and light environment which greatly enhances one's listening and entertainment pleasure. The changeability of the sound and light environment of a room permits one to change the ambiance of the room for any occasion. The mood of the room, particularly a living room where entertainment systems are normally present, is easily and conveniently changed.

In accordance with still another feature of this invention, it is further advantageous if the sound transmitted by the sound fixture means is a stereo sound. Thus, an elongated first audio channel conductor and an elongated second audio channel conductor are mounted on the support in substantial parallelism with each other. A first and a second audio channel signal, which together constitute stereo signals, are connected to the first and the second audio channel conductors.

Hence, the sound fixture means, which advantageously comprises a pair of sound fixtures, is permitted to transmit stereo sound. The first and second audio channel sounds which are transmitted by the pair of sound fixtures may come from any stereo sound source, such as a stereo phonograph, radio, audio tape recorder, television or the like.

The novel features which are considered as characteristic of the invention are set forth in particular in the appended claims. The invention itself, however, both as to its construction and its method of operation, together with additional object and advantages thereof, will be best understood from the following description of specific embodiments when read in connection with the accompanying drawings.

DETAILED DESCRIPTION OF THE PREFERRED EMBODIMENTS

Figure 1:
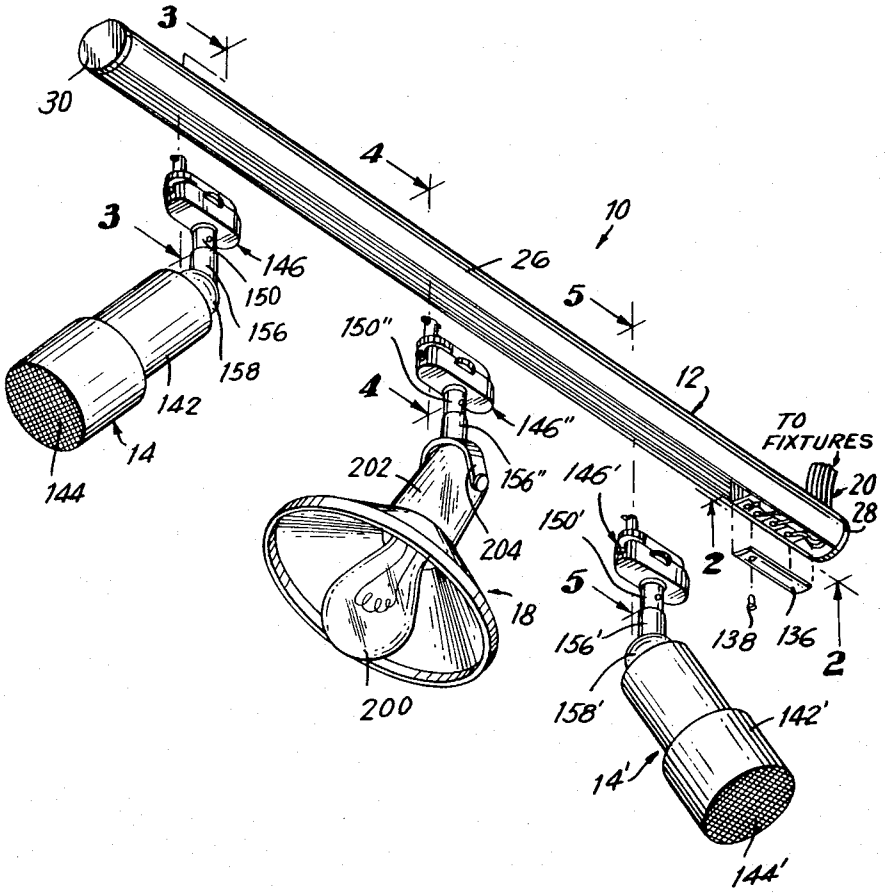
FIG. 1 is a perspective view of a stereo sound and light track system with several sound and light fixtures shown removed from an overhead support and with broken-away electrical wiring connected thereto.
Figures 6, 7, 8:
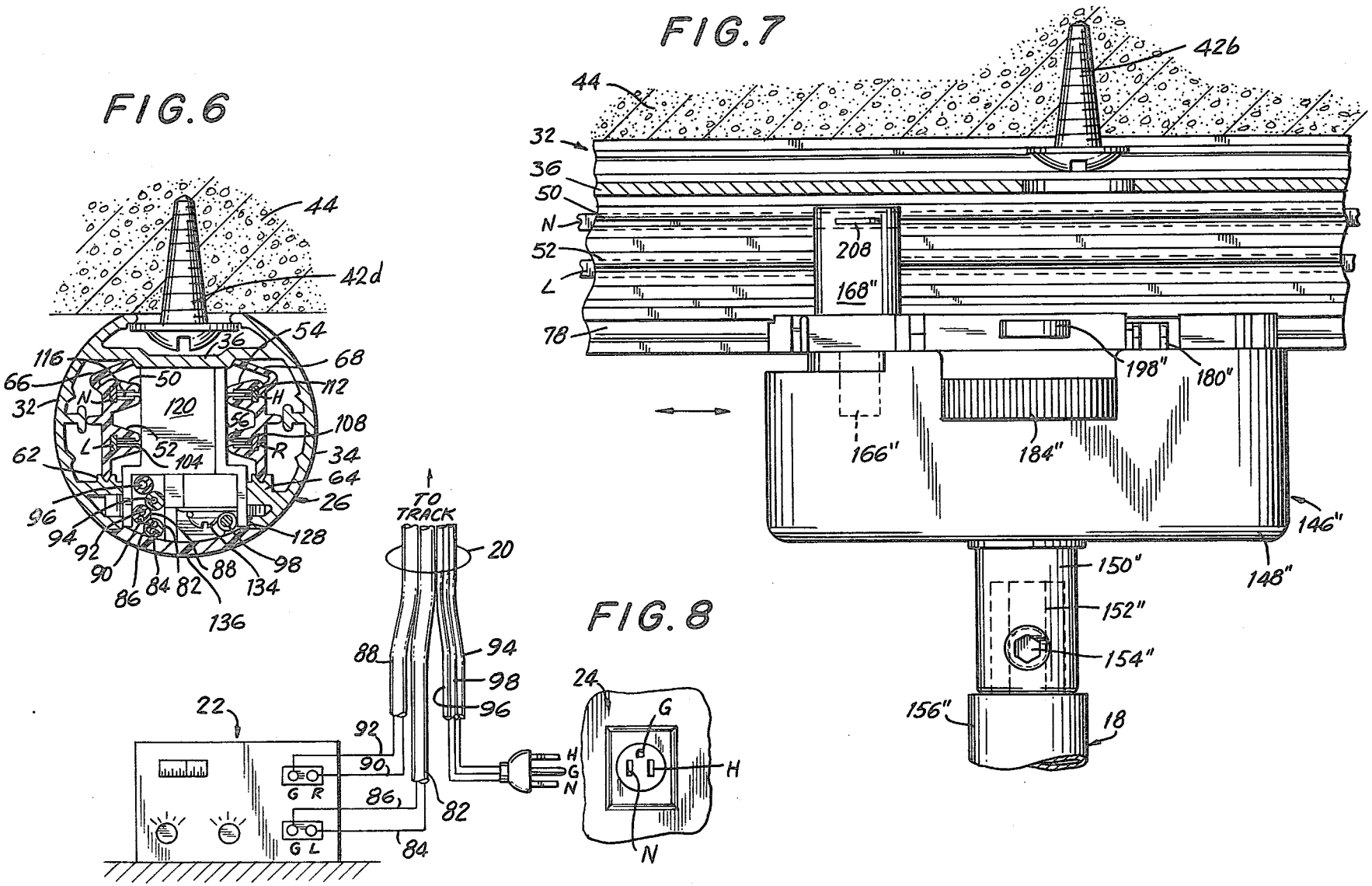
FIG. 6 is a cross-sectional view of the detail of FIG. 2 as taken along the line 6—6 thereof.
FIG. 7 is an axial view as taken along the line 7—7 of FIG. 4.
FIG. 8 is a diagrammatic view of the electrical wiring connected to the support of FIG. 1.

Referring now to the drawings, FIGS. 1 and 8 together show a stereo sound and light track system 10 comprising a support 12, a first or left audio channel sound fixture means 14, a second or right audio channel sound fixture means 14', and a light fixture means 18. The fixture means 14, 14', 18 are operatively connected by electrical wiring 20 to a stereo sound source 22 and to an electrical power source 24 are explained in detail below. The support 12 includes a generally elongated body portion or track 26, preferably of electrically conductive material, preferably extruded metal. The opposite open ends of the track 26 are closed by decorative end caps 28, 30. As best shown, for example, in FIG. 3, the track cross-section is generally circular, and constitutes a pair of arcuate track sections 32, 34 interconnected by an upper transverse web 36, and having opposite longitudinal edges spaced apart from each other to define an upper open space 38 and a lower open space 40. Means, preferably a set of anchoring elements such as wall mounting screws 42*a*, 42*b*, 42*c*, 42*d*, are mounted at the upper open space 38 lengthwise of the track 26. The heads of the wall mounting screws are operative to capture and clamp the upper edges of the arcuate track sections 32, 34, and to fixedly mount the track 26 on a support structure such as a ceiling 44. The upper portions of the fixture means 14, 14', 18 are received through the lower open space 40 and are mounted and secured on the track as described below.

A bus bar assembly is mounted on and within the track 26. The bus bar assembly includes an elongated left audio channel bus bar conductor L, and an elongated right audio channel bus bar conductor R, both of which are to be operatively connected to the sound source 22. The bus bar assembly also includes an elongated hot power bus bar conductor H, and an elongated neutral power bus bar conductor N, both of which are to be operatively connected to the power source 24. The conductors are rigid, substantially planar bars of electrically conductive material, preferably copper, which are mounted in substantial parallelism and in electrical insulation with each other on bus bar carriers 46, 48 that are, in turn, respectively mounted on track sections 32, 34. Bus bar carriers 46, 48 are constituted of electrically insulating material, preferably plastic or rubber. Carrier 46 has upper and lower C-shaped holders 50, 52 in which the conductors N and L are fixedly mounted. Carrier 48 has upper and lower C-shaped holders 54, 56 in which the conductors H and R are fixedly mounted. Carriers 46, 48 have lower feet 58, 60 which are respectively received in grooved base portions 62, 64 that are of one piece with track sections 32, 34. Carriers 46, 48 also have upper resilient arms 66, 68 which resiliently bear against depending respective shoulders of the transverse web 36 to thereby hold the carriers 46, 48 in place within the track with a snap-type action. Carriers 46, 48 further having intermediate spacer elements 70, 72 which respectively engage T-shaped spacer portions 74, 76 that are of one piece with track sections 32, 34. The bus bar assembly further includes a larger longitudinal locking recess 78 and a similar longitudinal locking recess 80 that are used as described below to mount and to lock the fixtures in place on the track.

Turning now to FIG. 8, the stereo sound source 22, which may be a phonograph, an audio tape recorder, a radio receiver, a television, etc., generates a first or left audio channel signal at left terminal L and its ground terminal G, and also generates a second or right audio channel signal at right terminal R and its ground terminal G. The electrical wiring 20 includes a first audio cable 82 which has a pair of electrically conductive wires 84, 86 respectively connected to terminals L and G. The wiring 20 also includes a second audio cable 88 which has a pair of electrically conductive wires 90, 92 respectively connected to terminals R and G. The audio cables 82, 88 are typically radio-frequency-shielded audio cables.

Figure 2:
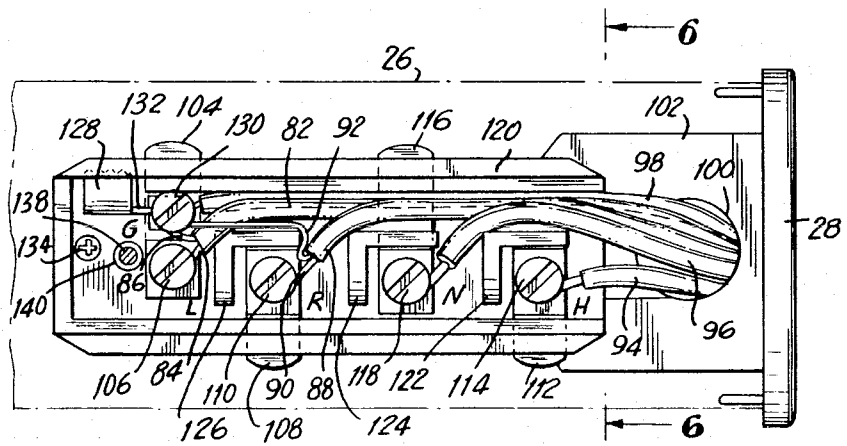
FIG. 2 is an enlarged bottom plan view of a detail of the support taken along the line 2—2 of FIG. 1.

The electrical power source 24 includes a conventional grounded wall outlet having three sockets H, N, G respectively connected to a hot power terminal, a neutral power terminal and a ground terminal connected to earth ground. A conventional three-pronged electrical plug having terminal pins H, N, G are respectively insertable in and connected to the hot, neutral and ground sockets. The electrical wiring 20 preferably includes a trio of electrical power cables 94, 96, 98, each of which has an electrically conductive wire that is connected to pins H, N, G, respectively. The power souce could also have been a conventional double-socketed wall outlet with the ground and neutral terminals electrically tied together, in which case, only a double-pronged plug and only two power cables would be needed. The three power cables 94, 96, 98 could also be replaced by a single cable having three interior conductive wires electrically insulated from one another. The audio cables 82, 88 and the power cables 94, 96, 98 are respectively routed from the sound source 22 and the power source 24, and operatively connected respectively to the audio and power bus bar conductors in the track 26. As best shown in FIG. 2, the various cables are routed through an opening 100 formed in a flange 102 that is integral with the end cap 28. The ends of the various cables are stripped bare of any protective insulation to expose the ends of the conductive wires therein. The exposed wire ends are connected to electrically conductive screw-mounted connectors having wire taps 104, 108, 112, 116 which are, in turn, connected to the bus bar conductors.

Thus, the exposed end of left channel wire 84 of audio cable 82 is clamped underneath the head of screw 106 to complete an electrically conductive path to the left channel tap 104. The exposed end of right channel wire 90 of audio cable 88 is clamped underneath the head of screw 110 to complete an electrically conductive path to the right channel tap 108. The exposed end of the conductive wire within hot power cable 94 is clamped underneath the head of screw 114 to complete an electrically conductive path to the hot power tap 112. The exposed end of the conductive wire within neutral power cable 96 is clamped underneath the head of screw 118 to complete an electrically conductive path to the neutral power tap 116. All of the taps are mounted on an electrically insulating holder 120, preferably of plastic material, which has upraised L-shaped projections 122, 124, 126 to assist in routing the cables along a predetermined orientation to their respectively associated screws, and in retaining the cables in predetermined correct positions on the holder 120.

As shown in FIG. 6, the left and right channel taps 104, 108 are at the same elevation on the holder 120, extend laterally outwardly of the holder in opposite directions, and respectively electromechanically engage the left and right channel bus bar conductors L and R. Similarly, the neutral and hot taps 116, 112 are located at the same elevation on the holder 120 but above the taps 104, 108, extend laterally outwardly of the holder in opposite directions, and respectively electromechanically engage the neutral and hot power bus bar conductors N and H.

A ground conductor 128 is also mounted on the holder 120, and is electrically connected to a ground screw 130 under the head of which the audio ground wires 86, 96 and the power ground wire of cable 98 are clamped. The ground connector 128 has a serrated tap which is resiliently mouned on a cantilever arm 132. As shown in FIG. 6, the serrated tap resiliently bears against the metal track 26 due to the inherent resilience of the arm 132 which is preferably made of a spring metal. The serrated tap engages the track to form an electromechanical connection therewith. In the even that a decorative paint is applied over the track, the serrated tap serves to scratch off the paint and dig into the track to ensure a good contact therewith. Thus, the metal track 26 is grounded to earth ground. The power source and the audio source and the track all share a common ground.

The holder 120 may be constituted of one or more housing parts and, in a preferred multi-part construction, an assembly screw 134 interconnects the parts. An arcuate cover 136 (see FIGS. 1 and 6) is mounted underneath the holder 120 to cover the screw-mounted connectors thereon by means of a mounting screw 138 that is threadedly received in a threaded anchoring tubular portion 140.

Thus, the left and right channel audio signals from the audio source 22 can be respectively picked off the bus bar conductors L and R anywhere along their lengths. The hot and neutral power can be respectively picked off the bus bar conductors H and N anywhere along their lengths. The electrical ground can be picked off the grounded track 26 anywhere along its length.

Figure 3:
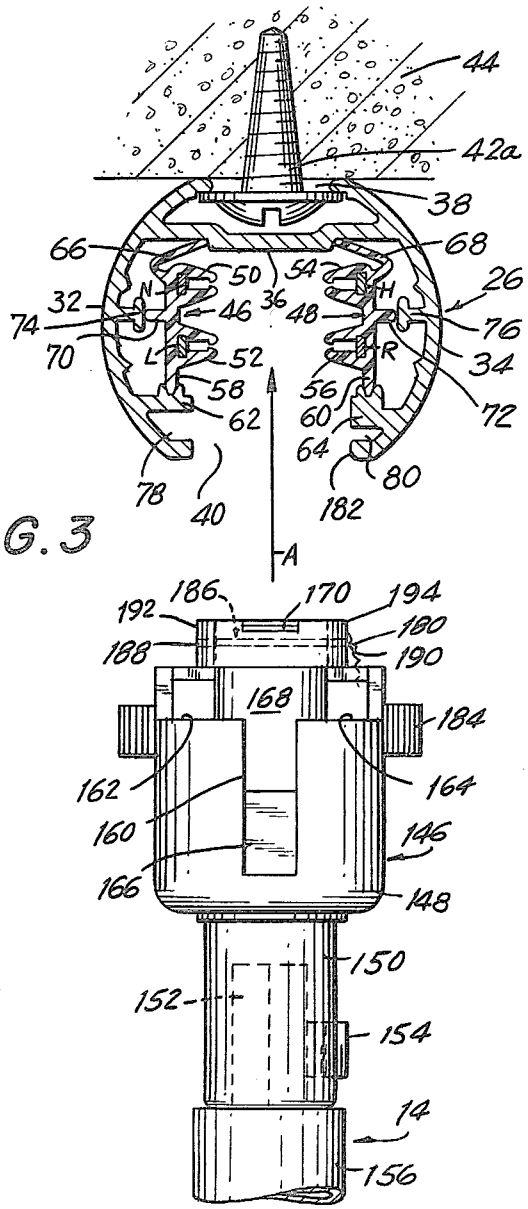
FIG. 3 is an enlarged cross-sectional view of the mounted support and a sound fixture means prior to mounting thereon as taken along the line 3—3 of FIG. 1.

Returning to FIG. 1, the sound fixture means 14 includes a housing 142, a speaker 144 mounted thereon, and means 146 for mounting the sound fixture housing on the track 26. As best shown in FIG. 3, the mounting means 146 includes an adapter housing 148 having a lower hollow tubular neck 150 into the interior of which a shaft 152 is fixed with a set screw 154. The shaft 152 is integrally connected to a tubular column 156 which is, in turn, connected to a universal ball-and-socket joint 158 (see FIG. 1) that is, in turn, mounted at the rear of the housing 142. The ball-and-socket joint 158 has multiple freedoms of movement, and constitutes means for manually adjusting the position of the speaker 144 to any orientation relative to the track.

A central vertical slot 160 is formed at the front of the adapter housing 148. A handle 166 extends outwardly of the slot 160, and is manually slidable therealong. A support cylinder 168 having a longitudinal axis of symmetry is connected to the handle 166. The cylinder 168 is raised upwardly when the handle is raised upwardly. Once the lower edge of handle 166 clears the upper horizontal edge of the front wall of the housing 148 during the upward movement, the handle can be manually moved horizontally, either toward the left through an arcuate slot 162 which extends approximately 90° about the aforementioned longitudinal axis, or toward the right through an arcuate slot 164 which also extends approximately 90° in the other circumferential direction about the longitudinal axis. During the movement about the longitudinal axis in either circumferential direction, the support cylinder 168 is turned approximately a quarter-turn about the longitudinal axis.

An audio connector 170, preferably a metal tab, is fixedly mounted on the support cylinder 168 for joint movement therewith. As shown in FIG. 3, the tab 170 extends out of the plane of the drawing and does not contact any bus bar conductor, even after the sound fixture means 14 has been mounted on the track. Once the sound fixture means 14 has been mounted on the track by moving the housing 148 in the direction of the arrow A—a condition shown in FIG. 5 for sound fixture means 14' wherein like parts with the sound fixture means 14 have been identified by primed numerals—and thereupon, after the tab 170 has been raised (by raising the handle 166), and thereupon, after the tab 170 has been turned to the left (by moving the handle 166 through slot 162), then the tab 170 will electromechanically contact the left channel conductor L to thereby define a first contact position. See, for example, FIG. 5, whereby the tab 170' electromechanically contacts left channel conductor L in the mounted condition of use of the sound fixture means 14'. On the other hand, if the raised tab 170 were turned to the right (by moving the handle through slot 164), then the tab 170 will electromechanically contact the right channel conductor R to thereby define a second contact position. See FIG. 5 again, for example, where the tab 170' is shown in dotted lines electromechanically contacting the right channel conductor R in the mounted condition of use of the sound fixture means.

Figure 5:
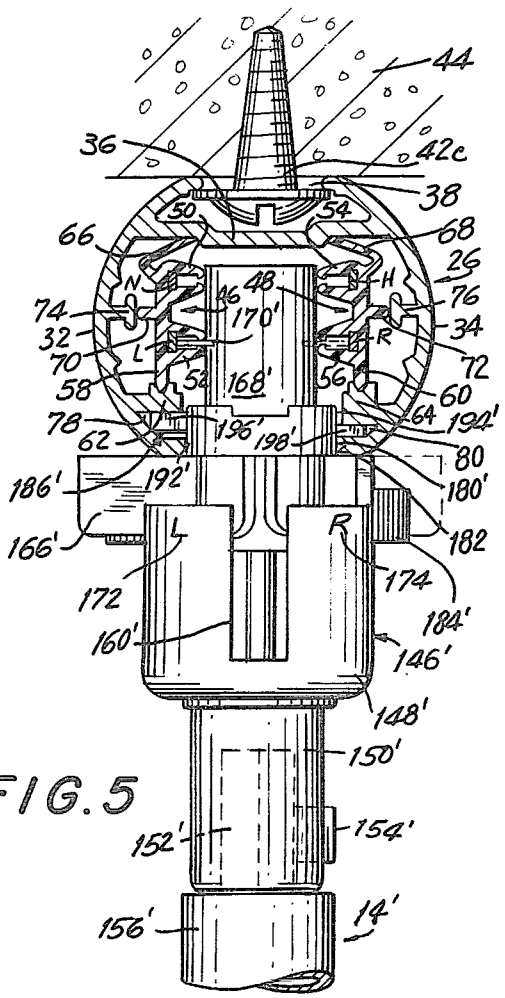
FIG. 5 is an enlarged cross-sectional view of the mounted support of another sound fixture means after mounting thereon as taken along the line 5—5 of FIG. 1.

Hence, by displacing the tab 170 to the left or to the right, a sound fixture means can be adapted to be connected to either the left audio channel or the right audio channel. Indicator means 172, 174 such as the reference letters "L" and "R" are applied on the front wall of the housing 148' to visually indicate to an installer, by noting the proximity of the handle 166' relative to the respective reference letter, whether the left or the right channel has been selected. In FIG. 5, the solid line representation of the handle 166' adjacent the reference letter "L" indicates that the sound fixture means 14' has been operatively connected to the left channel conductor L, and the phanom line representation of the handle 166' adjacent the reference letter "R" indicates the position of the handle if the sound fixture means 14' were operatively connected to the right channel conductor R.

Each speaker 144, 144' is a conventional loudspeaker having a pair of non-illustrated electrical wires connected thereto, and mounted within the respective sound fixture means. One wire is electrically connected to the audio connector tab 170 or 170'; the other wire is electrically connected to a ground connector 180 or 180' located at the side of the housing 148 or 148'. Each ground connector has an electrically conductive serrated engaging portion that is mounted on a resilient cantilever arm. In the mounted condition of use of the sound fixture means, as shown in FIG. 5, the serrated engaging portion resiliently bears in electromechanical contact against a lower and grounded longitudinal edge 182 of track section 34. The serrated edge may even scratch and dig into the track section 34, or at least through any decorative paint applied thereto, to ensure a better electrical contact.

Each sound fixture means is operative for transmitting audio sound when an audio signal is applied to audio connector 170 or 170', and when grounded at ground connector 180 or 180'. Thus, sound fixture means 14 will transmit left channel sound when mounted on the track so that its audio connector 170 is placed in contact with left channel audio connector L, and so that its ground connector 180 is placed in contact with the grounded track section 34. Also, sound fixture means 14' will transmit right channel sound when mounted on the track so that its audio connector 170' is placed in contact with right channel audio conductor R, and so that its ground connector 180' is placed in contact with the grounded track section 34. Together, both sound fixture means 14 and 14' will transmit stereo sound.

Connectors 170, 180 or 170', 180' mount the sound fixture means 14 or 14' in electromechanical connection with the respective audio conductor and ground. In order to fixedly mount and lock each sound fixture means in place on the track, a knurled rotary thumb wheel 184 or 184' is mounted on the housing 148 or 148' for rotation about a vertical axis. A locking wheel 186 or 186' is connected to and above each thumb wheel and rotates therewith. Each locking wheel has two opposed flats and two opposed locking projections spaced alternatingly and equiangularly aound the locking wheel. As shown in FIG. 3, the locking wheel 186 has two opposed flats 188, 190 which respectively lie in the same vertical planes as the side walls 192 and 194 of the housing 148. The flats 188, 190 offer no mechanical interference to the insertion of the upper portion of the sound fixture means 14 in the direction of the arrow A through the lower space 40 into the interior of the track 26. Once inserted, the thumb wheel 184 may be rotated a quarter-turn to cause the locking projections to extend outwardly beyond the side walls 192, 194 of the housing. Thus, as shown in FIG. 5, the locking projections 196', 198' extend past the side walls 192', 194' of the housing 148' into the aforementioned locking spaces 78, 80 to be tightly received in a locking wedged engagement therewith. The locking projection 196' is wider than the projection 198' so as to fit in the corresponding larger space 78. This latter feature guarantees that the sound fixture means can only be mounted in one correct orientation relative to the track, and thereby ensures that the "L" and "R" indicators will be proper.

Returning to FIG. 1, the light fixture means 18 includes a light bulb 200, a light fixture housing 202, and means 204 for adjustably positioning the housing 202 with multiple freedoms of movement to any orientation relative to the support. The adjusting means 204 preferably constitutes a swivel joint for pivoting the housing. The housing 202 is mountable on the track 26 by an adapter housing whose structure, function and mounting on the track 26 are analogous to that described earlier for the sound fixture means and, hence, are not believed to require any extended discussion, except to point out that like elements have been identified by double-primed numerals, and that the connector tabs located on the support cylinder are different as described below.

Figure 4:
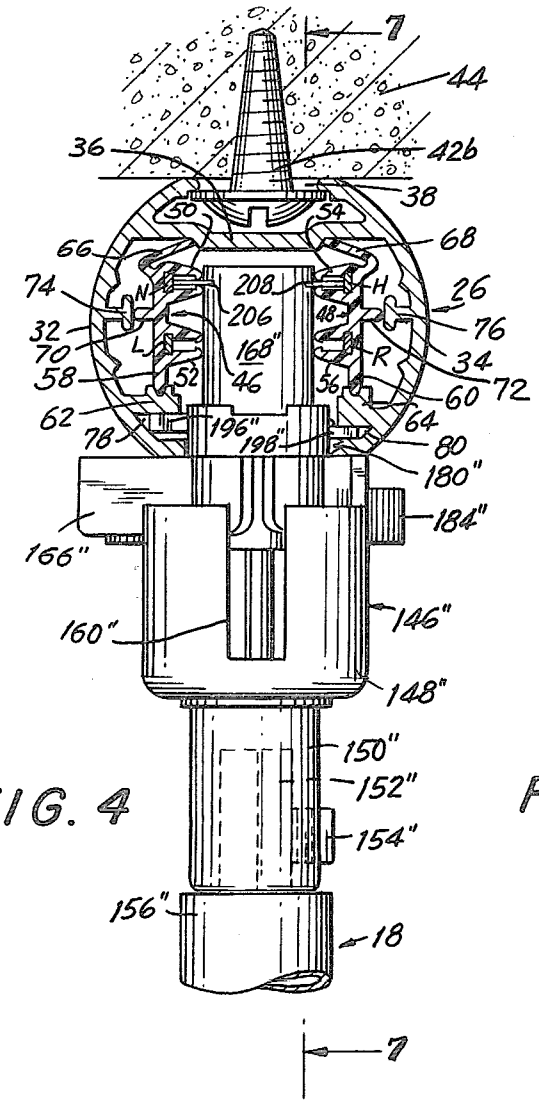
FIG. 4 is an enlarged cross-sectional view of the mounted support and a light fixture means after mounting thereon as taken along the line 4—4 of FIG. 1.

Thus, as shown in FIG. 4, a pair of electrically conductive power connector tabs 206, 208 are mounted on a support cylinder 168'' at a higher elevation than that described earlier for the aforementioned audio connector tabs 170 or 170'. The power tabs 206, 208 are colinear and extend outwardly at opposite sides of the cylinder 168''. When a handle 166'' is in a vertical central slot 160'', the tabs 206, 208 do not make contact with the power conductors N and H. When the handle 166″ is in the illustrated left position or in the non-illustrated right position, the tabs 206, 208 electromechanically contact the power conductors H and N. In addition, a ground tab 180″ electromechanically contacts the grounded metal track 26. Three non-illustrated electrical wires from the light bulb socket are mounted within the light fixture means 18 and are individually connected to the power tabs 206, 208 and the ground tab 180″. Hence, electrically conductive paths extend from the hot, neutral and ground terminals of the power source to the light fixture means to enable the light bulb to emit light in any desired mounting position.

Each sound fixture means and the light fixture means, as shown by the double-headed arrow B in FIG. 7, is independently adjustably movable on and along the track in an infinitely variable and continuous manner to any mounted position therealong. Each audio tab 170 or 170′ and each power tab 206 and 208 will make contact with their respective associated bus bar conductor anywhere along the length of the latter. Each fixture means is independently lockable or unlockable by turning its associated thumb wheel to fixedly secure or release, respectively, the fixture means from its mounted position.

It will be understood that each of the elements described above, or two or more together, may also find a useful application in other types of constructions differing from the types described above.

For example, this invention is not limited to mounting a pair of sound fixtures on a track. In a broader aspect, a single sound fixture can be mounted on the track to transmit monaural sound. Nor is this invention intended to be limited to mounting just two sound fixtures on a track, because it is evident that more than two sound fixtures can be so mounted. In the case of transmitting stereo sound, it is not necessary that two sound fixtures be used as described above, but a single sound fixture could be adapted to transmit both the right and left channel sounds.

Various combinations of sounds emanating from different audio sources and from different sound fixtures are likewise contemplated by this invention. Thus, for example, a pair of sound fixtures can be used to transmit stereo sound from a radio receiver. A second pair of sound fixtures can be used to transmit stereo sound from another stereo sound source such as a phonograph. A fifth sound fixture can also be used to transmit monaural sound from a television set. Individual sound fixtures can be switched off so as not to transmit any sound at all. Many other combinations are self-evident.

It should also be noted that this invention is not limited to mounting a single light fixture on a track. No light fixtures or more than one light fixture could be mounted on the track. The light fixtures need not contain a light bulb but could contain any light source. In another embodiment of this invention, the light source, once energized, could remain continuously on, or may flash intermittently and, preferably, in a manner depending upon the amplitude and/or frequency of the sound emanating from one or more of the sound fixtures. Different colored lights may also be used to enhance the different lighting combinations that may be obtained with this invention.

Another non-limiting aspect of this invention relates to the support track. The track may or may not be mounted on a ceiling, and can equally well be mounted on the walls of a room in a vertical or horizontal orientation relative to the floor of the room. The track could also be mounted on a wall unit. The track need not be directly mounted on the ceiling, but could be suspended therefrom. The track also need not extend along a straight line as shown in the drawings, but could equally well extend along many different courses such as a circular or oval course, or a non-linear course.

In addition, this invention is not intended to be limited to the mounting of four bus bar conductors within the track. In its simplest form, a single bus bar conductor connectable to the sound fixture means is sufficient. In the case of mounting the light fixture means to the track, the neutral power conductor could be grounded. In more complex systems, the use of more than four conductors is also within the spirit of this invention. It is likewise contemplated that the track itself need not be electrically grounded, but, instead, a separately grounded bus bar conductor could be mounted on the track in a manner analogous to the aforementioned audio and power bus bar conductors. In this case, the track is preferably constituted of an electrically insulating material, typically extruded plastic material. Still further, the particular orientation and positioning of the hot and neutral power conductors at one level within the track, and the positioning of the right and left audio conductors at another level within the track could be altered.

The power source 24 is not intended to be limited to the illustrated wall outlet, but can be a power source located in a ceiling, wall or floor electrical junction outlet box. In a preferred installation, the power source will be taken from power wires in a ceiling junction box so that the power wires routed to the track are hidden from view behind the ceiling. The power source 24 is not to be confused with the source of electrical power for energizing the sound source. Electrical power for the sound source can be derived from a battery, a wall outlet, or an electrical junction outlet box in the ceiling, wall or floor. If the electrical power for the sound source is derived from a wall outlet, and if the power source is also a wall outlet, then either the same or different wall outlets could be used.

While the invention has been illustrated and described as embodied in a stereo sound and light track system, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should, and are intended to, be comprehended within the meaning and range of equivalence of the following claims.

What is claimed as new and desired to be protected by Letters Patent is set forth in the appended claims:

1. A sound track system, comprising:

(a) a support;

(b) an elongated audio bus bar conductor;

(c) means for mounting the audio conductor on the support;

(d) means for connecting an electrical audio signal to the audio conductor for electrical conduction therealong;

(e) grounding means for providing on the support an electrical ground which extends substantially parallel to the elongation of the audio conductor and which is electrically insulated from the same;

(f) sound fixture means for transmitting sound when operatively connected to the audio signal and the ground; and (g) connector means for fixedly mounting the sound fixture means on the support in electro-mechanical fixed connection with, and in any desired fixedly mounted position along, the audio conductor and the ground, thereby permitting the sound fixture means to transmit sound in any desired mounted position.

2. The sound track system as defined in claim 1, wherein the support includes an electrically conducting body portion which extends along the elongation of the audio conductor, and wherein the audio conductor is mounted in electrical insulation with the body portion, and wherein the grounding means electrically grounds the body portion.

3. The sound track system as defined in claim 2, wherein the connector means includes an audio connector mounted on the sound fixture means and electromechanically contacting the audio conductor in each mounted position, and a ground connector mounted on the sound fixture means and electromechanically contacting the grounded body portion in each mounted position.

4. The sound track system as defined in claim 3; and further comprising another elongated audio bus bar conductor, means for mounting the other audio conductor on the support in substantial parallelism with the audio conductor, and means for connecting another electrical audio signal to the other audio conductor for electrical conduction therealong; and wherein the connector means includes means for mounting the audio connector for displacement between a first contact position and a second contact position in which the audio connector respectively contacts the audio conductor and the other audio conductor for respectively conducting the audio signal and the other audio signal.

5. The sound track system as defined in claim 4; and further comprising indicator means on the sound fixture means for visually indicating the contact position to which the audio connector has been displaced.

6. The sound track system as defined in claim 3, wherein the audio connector and the ground connector are each positionable in infinitely variable manner on and along the audio conductor and the body portion respectively.

7. The sound track system as defined in claim 1, wherein the sound fixture means includes a speaker, and means for adjustably positioning the speaker to any desired orientation relative to the support.

8. The sound track system as defined in claim 1; and further comprising another elongated audio bus bar conductor, means for mounting the other audio conductor on the support, means for connecting another electrical audio signal to the other audio conductor for electrical conduction therealong, said audio signal and said other audio signal together constituting stereo signals, another sound fixture means for transmitting sound when operatively connected to the other audio signal and to the ground, and another connector means for fixedly mounting the other sound fixture means on the support in electro-mechanical fixed connection with, and in any desired fixedly mounted position along, the audio conductor and the ground, thereby permitting both sound fixture means to transmit stereo sound in any of their respective mounted positions.

9. The sound track system as defined in claim 1, wherein the support is an overhead support, and wherein the connector means is operative for fixedly mounting the sound fixture means below the overhead support.

10. The sound track system as defined in claim 4, wherein the connector means includes a manually actuatable handle operatively connected to the audio connector for manually displacing the latter between its contact positions.

11. A sound and light track system, comprising:

(a) a support;

(b) a bus bar assembly including an elongated audio conductor, an elongated hot power conductor and an elongated neutral power conductor;

(c) means for mounting the conductors in substantial parallelism with and electrically insulated from each other on the support;

(d) means for connecting an electrical audio signal to the audio conductor for electrical conduction therealong;

(e) means for connecting a hot terminal of an electrical power source to the hot power conductor;

(f) means for connecting a neutral terminal of the power source to the neutral power conductor;

(g) grounding means for providing on the support an electrical ground which extends in substantial parallelism to the elongated conductors and electrically insulated from the same;

(h) sound fixture means for transmitting sound when operatively connected to the audio signal and the ground;

(i) means for mounting the sound fixture means in electro-mechanical connection with the audio conductor and the ground, and for movement along the elongation of the audio conductor to any mounted position on the support in each of which the sound fixture means is simultaneously electro-mechanically connected with the audio conductor and the ground;

(j) light fixture means for emitting light when operatively connected to the hot and neutral terminals and the ground; and (k) means for mounting the light fixture means in electro-mechanical connection with the power conductors and the ground, and for movement along the elongation of the power conductors to any mounted position on the support in each of which the light fixture means is simultaneously electro-mechanically connected with the power conductors and the ground, thereby permitting the sound fixture means to transmit sound and the light fixture means to emit light in any of their respective mounted positions.

12. The sound and light track system as defined in claim 11, wherein the support includes an electrically conducting body portion which extends along the elongation of the conductors, and wherein the conductors are mounted in electrical insulation with the body portion, and wherein the grounding means electrically grounds the body portion.

13. The sound and light track system as defined in claim 12, wherein the sound fixture mounting means includes an audio connector mounted on the sound fixture means and electro-mechanically contacting the audio conductor in each mounted position of the sound fixture means, and wherein the light fixture mounting means includes a hot connector and a neutral connector mounted on the light fixture means and respectively electro-mechanically contacting the hot power conductor and the neutral power conductor in each mounted position of the light fixture means, and wherein the grounding means includes a ground connector mounted on each of the sound fixture means and the light fixture means and electromechanically contacting the grounded body portion in each of their respective mounted positions.

14. The sound and light track system as defined in claim 13, wherein each connector is positionable in infinitely variable manner on and along its respectively associated conductor and body portion.

15. The sound and light track steam as defined in claim 11, wherein the sound fixture means includes a speaker, and means for adjustably positioning the speaker to any desired orientation relative to the support; and wherein the light fixture means includes a light bulb, and means for adjustably positioning the light bulb to any desired orientation relative to the support.

16. The sound and light track system as defined in claim 11, wherein the light fixture means and the sound fixture means are independently movable; and further comprising means for independently locking the light fixture means and the sound fixture means in their respective desired mounted positions.

17. A stereo sound and light track system, comprising:

(a) a support;

(b) a bus bar assembly including an elongated first audio channel conductor, an elongated second audio channel conductor, an elongated hot power conductor and an elongated neutral power conductor;

(c) means for mounting the conductors in substantial parallelism with and electrically insulated from each other on the support;

(d) means for connecting an electrical first audio channel signal to the first audio channel conductor for electrical conduction therealong;

(e) means for connecting an electrical second audio channel signal to the second audio channel conductor for electrical conduction therealong, said first and second audio channel signals constituting stereo signals;

(f) means for connecting a hot terminal of an electrical power source to the hot power conductor;

(g) means for connecting a neutral terminal of the power source to the neutral power conductor;

(h) grounding means for providing on the support an electrical ground which extends in substantial parallelism to the elongated conductors and which is electrically insulated from the same;

(i) sound fixture means for transmitting stereo sound when operatively connected to the audio channel signals and the ground;

(j) means for mounting the sound fixture means in electro-mechanical connection with the audio conductors and the ground, and for movement along the elongation of the audio conductors to any mounted position on the support in each of which the sound fixture means is simultaneously electro-mechanically connected with the audio conductors and the ground;

(k) light fixture means for emitting light when operatively connected to the hot and neutral terminals and the ground; and (l) means for mounting the light fixture means in electro-mechanical connection with the power conductors and the ground, and for movement along the elongation of the power conductors to any mounted position on the support in each of which the light fixture means is simultaneously electro-mechanically connected with the power conductors and the ground, thereby permitting the sound fixture means to transmit stereo sound and the light fixture means to emit light in any of their respective mounted positions.

18. The stereo sound and light track system as defined in claim 17; and further comprising means for mounting the support on an overhead support structure; and wherein the support includes an electrically conducting body portion which extends along the elongation of the conductors, and wherein the conductors are mounted in electrical insulation with the body portion, and wherein the grounding means electrically grounds the body portion.

19. The stereo sound and light track system as defined in claim 17, wherein each connecting means includes an electrically conducting wire tap which electromechanically contacts the respectively associated conductor; and further comprising an electrically insulating holder mounted on the support for supporting each tap.

20. The stereo sound and light track system as defined in claim 17, wherein the sound fixture means includes a first sound fixture for transmitting first audio channel sound when operatively connected to the first audio channel signal, and a second sound fixture for transmitting second audio channel sound when operatively connected to the second audio channel signal; and wherein the first and second sound fixtures are independently movable in infinitely variable manner relative to each other and relative to the light fixture means.

21. The stereo sound and light track system as defined in claim 20, wherein the sound fixture mounting means includes a first audio connector mounted on the first sound fixture and electromechanically contacting the first audio channel conductor in each mounted position of the first sound fixture, and a second audio connector mounted on the second sound fixture and electromechanically contacting the second audio channel conductor in each mounted position of the second sound fixture, and wherein the light fixture mounting means includes a hot connector and a neutral connector mounted on the light fixture mounting means and respectively electromechanically contacting the hot power conductor and the neutral power conductor in each mounted position of the light fixture means, and wherein the grounding means includes a ground connector mounted on each sound fixture and on the light fixture means and electromechanically contacting the electrical ground on the support in each of their respective mounted positions.

* * * * *